US008558696B2

(12) United States Patent
Baumann et al.

(10) Patent No.: US 8,558,696 B2
(45) Date of Patent: Oct. 15, 2013

(54) SURVEILLANCE SYSTEM, METHOD AND COMPUTER PROGRAM FOR DETECTING AND/OR TRACKING A SURVEILLANCE OBJECT

(75) Inventors: Axel Baumann, Giesen (DE); Hartmut Loos, Hildesheim (DE); Jan Karl Warzelhan, Bad Salzdefurth Ot Heinde (DE)

(73) Assignee: Robert Bosch GmbH, Stuttgart (DE)

( * ) Notice: Subject to any disclaimer, the term of this patent is extended or adjusted under 35 U.S.C. 154(b) by 8 days.

(21) Appl. No.: 13/062,047

(22) PCT Filed: Aug. 17, 2009

(86) PCT No.: PCT/EP2009/060625

§ 371 (c)(1),
(2), (4) Date: Apr. 4, 2011

(87) PCT Pub. No.: WO2010/028933

PCT Pub. Date: Mar. 18, 2010

(65) Prior Publication Data

US 2011/0175738 A1 Jul. 21, 2011

(30) Foreign Application Priority Data

Sep. 10, 2008 (DE) ..... 10 2008 041 933

(51) Int. Cl.
*G08B 13/00* (2006.01)

(52) U.S. Cl.
USPC ..... 340/541; 340/539.13; 340/573.1; 340/573.4

(58) Field of Classification Search
USPC ..... 340/572.1, 573.4, 584, 670, 539.13, 340/541, 573.1; 348/152, 169; 382/103
See application file for complete search history.

(56) References Cited

U.S. PATENT DOCUMENTS

| | | | |
|---|---|---|---|
| 7,175,528 | B1 | 2/2007 | Cumbers |
| 7,684,591 | B2 | 3/2010 | Tamura et al. |
| 2003/0058084 | A1 | 3/2003 | O'Hara |

(Continued)

FOREIGN PATENT DOCUMENTS

| | | |
|---|---|---|
| CN | 1829320 | 9/2006 |
| DE | 101 38 763 | 2/2003 |
| EP | 0 629 764 | 12/1994 |

*Primary Examiner* — Hoi Lau

(74) *Attorney, Agent, or Firm* — Michael J. Striker

(57) ABSTRACT

The invention relates to a monitoring system (1) for detecting and/or tracking at least one moving monitoring object (4) in a monitoring area (2), having a plurality of monitoring sensors (6) which are and/or can be spatially distributed in the monitoring area (2) and which are designed to detect the monitoring object (4) and to output detected object information, having a signature lock (8*a, b, c, d*) having at least one signature sensor (9) which is designed and/or arranged to detect the monitoring object (4) and to output object signature information, having an evaluation device (10) which is designed to create and/or add to an object signature (16) of the monitoring object (4) based on the object signature information and to detect and/or track the monitoring object (4) by comparing detected object information to the object signature (16) of the monitoring object (4), wherein the signature lock (8*a, b, c, d*) comprises at least two signature sensors (9) and is designed in such a way that the object signature information of the at least two signature sensors (9) can be associated with the monitoring object distinctly and/or unmistakably.

11 Claims, 1 Drawing Sheet

(56) References Cited

U.S. PATENT DOCUMENTS

| | | | | |
|---|---|---|---|---|
| 2003/0197612 | A1* | 10/2003 | Tanaka et al. | 340/572.1 |
| 2004/0117638 | A1 | 6/2004 | Monroe | |
| 2005/0089198 | A1 | 4/2005 | Ono et al. | |
| 2005/0171787 | A1 | 8/2005 | Zagami | |
| 2006/0064384 | A1* | 3/2006 | Mehrotra et al. | 705/57 |
| 2007/0222595 | A1* | 9/2007 | Motteram et al. | 340/572.1 |
| 2010/0019905 | A1* | 1/2010 | Boddie et al. | 340/572.1 |
| 2010/0259611 | A1* | 10/2010 | Keshavarzian et al. | 348/143 |

* cited by examiner

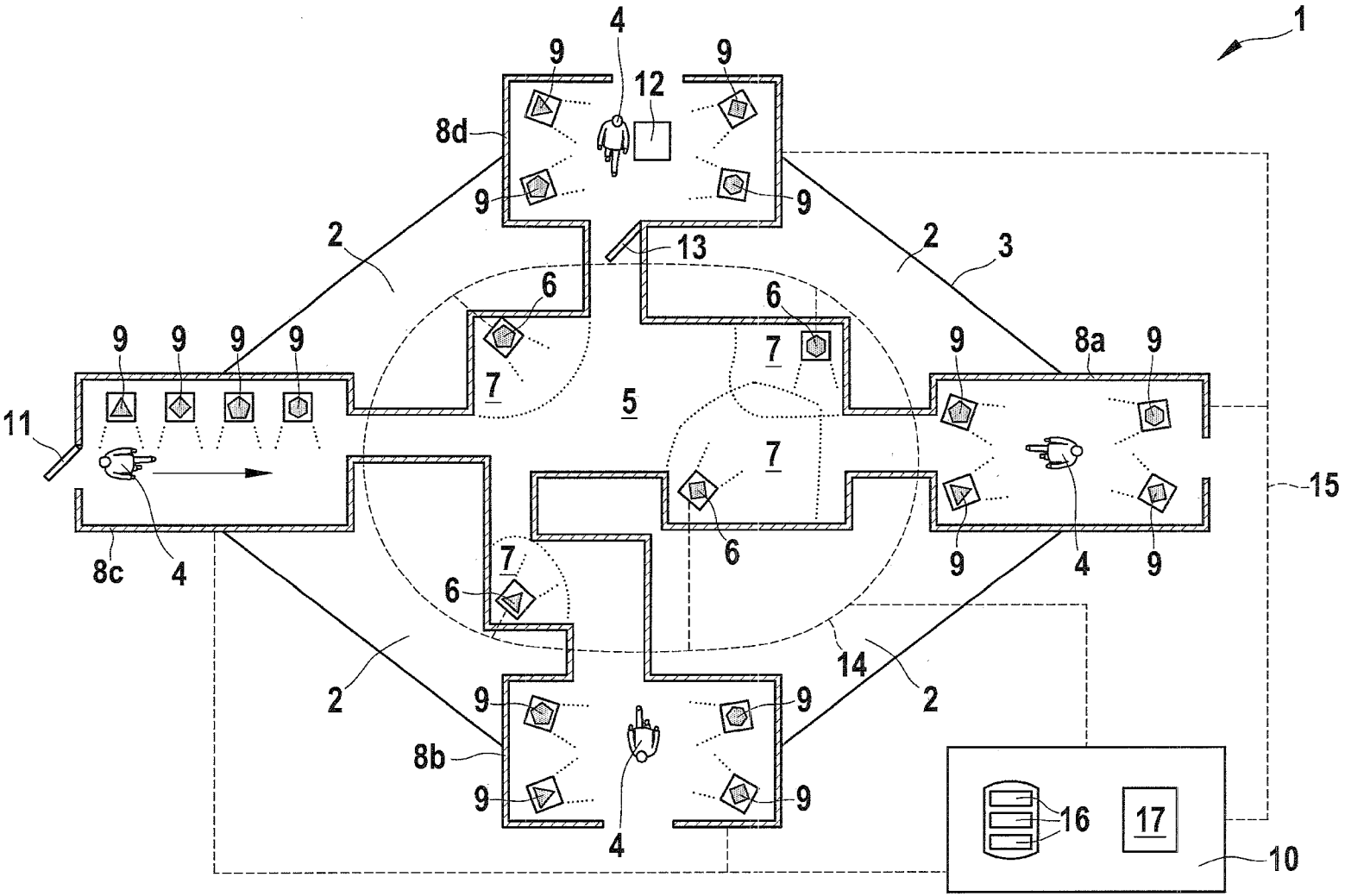
1
15
10
17
16
9
8a
4
3
2
14
6
7
5
13
12
8d
8b
8c
11

SURVEILLANCE SYSTEM, METHOD AND COMPUTER PROGRAM FOR DETECTING AND/OR TRACKING A SURVEILLANCE OBJECT

CROSS-REFERENCE TO A RELATED APPLICATION

The invention described and claimed hereinbelow is also described in German patent Application DE 10 2008 041 933.8 filed on Sep. 10, 2008. This German Patent Application, whose subject matter is incorporated here by reference, provides the basis for a claim of priority of invention under 35 U.S.C. 119 (a)-(d).

BACKGROUND INFORMATION

The invention relates to a surveillance system for detecting and/or tracking at least one moving surveillance object in a surveillance region, comprising a plurality of surveillance sensors which are and/or can be spacially distributed in the surveillance region, and which are designed to detect the surveillance object and output detected object information, comprising an evaluation device designed to detect and/or track the surveillance object by comparing detected object information with an object signature of the surveillance object, and comprising a signature lock having at least two signature sensors which are designed and/or disposed to detect the surveillance object and output object signature information. The invention furthermore relates to a method for detecting and/or tracking a surveillance object, and to a computer program.

In the case of typical video surveillance systems, such as those used to monitor public and private buildings or spaces, streets, intersections, train stations, etc., surveillance regions are recorded using surveillance cameras, and the image data streams from the surveillance cameras are usually combined in a surveillance center. The image data streams can be evaluated by surveillance personnel, although image processing algorithms are often used to evaluate the image data streams in an automated manner.

According to a typical procedure for performing evaluation in an automated manner using image processing algorithms, moving objects are separated from the (substantially stationary) background in the scene of the surveillance region, are tracked over time, and alarms are triggered e.g. if relevant movements occur. Surveillance systems are also known that utilize other sensor systems instead of surveillance cameras.

Surveillance objects are particularly difficult to track when the surveillance region covers a wide area and the surveillance cameras or other sensors cover only subregions of the surveillance region.

Publication DE 10 138 763 A1 relates to another technical field, namely authorization for persons to access a security region. According to the aforementioned publication, a plurality of biometric sensors is used to provide biometric data which then define access authorizations to closed regions in the security region.

DISCLOSURE OF THE INVENTION

The invention relates to a surveillance system having the features of claim 1, a method for detecting and/or tracking a surveillance object having the features of claim 11, and to a computer program having the features of claim 12. Preferred or advantageous embodiments of the invention result from the dependent claims, the description that follows, and the attached figures.

Within the scope of the invention, a surveillance system is provided that is suited and/or designed to detect and/or track at least one moving surveillance object in a surveillance region. The moving surveillance object is preferably embodied as a person; in modified embodiments, the moving surveillance object can also be embodied as a vehicle, an object moving under its own force, and/or an object being moved by an outside force. It is possible, of course, for the surveillance system to detect or track more than one surveillance object simultaneously.

The surveillance region can include individual regions under an open sky and/or regions in, on, and/or under a structure, in particular a building. The individual regions can be contiguous or, in alternative embodiments, the individual regions can be situated such that they are separate from each other. In a building it is possible, for example, to monitor a plurality of floors of the building as the surveillance region.

The surveillance system includes a plurality of surveillance sensors which are and/or can be spacially distributed in the surveillance region. The surveillance sensors can overlap with the detection regions, or be disposed such that there is partially no overlap.

The surveillance system includes a signature lock which, in the most general case, can be designed as an unlimited lock region. In other embodiments, the lock region is limited by structural measures or is designed as a lock room or a lock device. A least one signature sensor is disposed in the lock region, which is designed to detect the surveillance object and output object signature information. The signature sensor can be designed analogously to one of the surveillance sensors. The sensors, i.e. the surveillance sensors and/or signature sensors, are designed to register various object properties of the surveillance object, which are suitable and/or usable for monitoring, detecting, and/or tracking the surveillance object, and which can be output as object information or object signature information.

An evaluation device, which is part of the surveillance system, is designed to detect and/or track, in particular to identify, the surveillance object by comparing object information from at least one surveillance sensor with an object signature of the surveillance object. The object signature is preferably designed as a combination of object signature information that was obtained selectively and/or individually for a single surveillance object.

According to the invention, the signature lock includes at least two, preferably three, and in particular at least four or more signature sensors, the signature lock being designed such that the object signature information from at least two signature sensors can be assigned distinctly and/or unmistakably to the surveillance object.

An advantage of the surveillance system is that forming the object signature using the object signature information from the signature lock ensures that all object signature information that contributes to forming the object signature actually arises from a single surveillance object. If the concept according to the invention is compared e.g. with a concept of a continuous object signature, in which uncorrelated surveillance sensors contribute to the formation of the object signature, the risk always exists that the surveillance objects will be mixed up and erroneous signature data will be entered in the object signature. A robust object signature for the surveillance object can be created via the complete or approximately complete detection of object signature data of a surveillance object at a certain point in time at a certain location or region.

A further advantage of the invention is that, once the signature lock has been passed through, a complete or at least comprehensive individual object signature is formed for the surveillance object or each subsequent surveillance object, the object signature having been created on the basis of the detections performed by preferably all signature sensors in the signature lock. Preferably, it is provided that the object signature is formed entirely in the signature lock i.e. that the signature lock include all signature sensors that can provide the object signature information required to form the object signature.

According to a first possible embodiment of the invention, at least two signature sensors are designed and/or disposed to detect the surveillance object in a manner that overlaps in terms of space and/or time, and to detect the surveillance object in a manner that is correlated in terms of time and/or space. For example, the surveillance object is detected concurrently or simultaneously from all sides using an appropriate number of signature sensors. It is also possible to use a plurality of similar signature sensors. Particularly preferably, at least two surveillance cameras are provided for the concurrent or simultaneous detection of different views of the surveillance object. For example, a front view and a rear view, or a side view and a side view of the opposite side of the surveillance object are recorded. In particular, the signature sensors used to record the object signature are positioned such that they do not interfere with each other.

According to another possible embodiment, the signature lock includes an isolating device for isolating the surveillance object, the at least two signature sensors being disposed in an isolating region to detect the isolated surveillance object there. According to this structural embodiment, the temporal and/or spacial correlation is achieved by ensuring that only one individual surveillance object can be present in a specified region of the signature lock, and therefore all sensor-specific detections performed in the isolating region absolutely must belong to the isolated surveillance object.

Particularly preferably, the signature lock is disposed at an entrance to the surveillance region. In this embodiment, the surveillance object is advantageously detected in entirety as an object signature when it enters or penetrates the surveillance region, thereby making it possible to detect and/or track the surveillance object everywhere in the surveillance region on the basis of the object signature. It is also possible for a plurality of signature locks to be disposed at a plurality of entrances to the surveillance region.

According to a particularly preferred embodiment of the invention, the signature lock is designed to be activated automatically to detect the surveillance object. Therefore, no action is required by the user, e.g. from surveillance personnel or the surveillance object, to start the formation of the object signature. For example, the formation of the object signature is started as soon as the surveillance object is located in a certain position.

According to an alternative embodiment of the invention, the signature lock is designed to be activated manually e.g. by the surveillance object or the surveillance personnel. It can be provided e.g. that the surveillance object must perform a certain action to start the formation of the object signature. This embodiment may be practical when approval must be obtained from the surveillance object before the object signature can be formed e.g. for reasons of data security.

As an option for all embodiments, means can be provided for ensuring that access to the surveillance region is not granted until the object signature has been formed.

According to a practical embodiment, it is preferable for the signature sensors and/or the surveillance sensors to include one or more of the following general classes of sensors:

- Surveillance cameras, preferably stationary or moving (e.g. pan-tilt-zoom cameras) surveillance cameras having various observation wavelengths (UV, VIS, NIR, IR), in particular for detecting all sides of the view of the surveillance object and/or for measuring the actual size or dimensions of the surveillance object;
- Odor sensors for recording an olfactive object property;
- Temperature sensors for recording a temperature of the surveillance object;
- A scale for determining the weight of the surveillance object;
- Acoustic sensors e.g. microphones, to record typical sounds such as respiration, heartbeat, engine noises, etc.
- Sensors for detecting electromagnetic radiation e.g. terahertz radiation; radiation measurement for detecting signals from computers, cellular telephones, RFID, etc.
- In addition, sensors can be used to detect biometric data such as facial analysis, fingerprints, and/or kinematic data such as patterns of movement.

The object information or object signature information can contain features in terms of color, texture, features from the digital image processing, size, weight, radiation property, temperature, etc.

According to a particularly preferred embodiment of the surveillance system, the totality of signature sensors covers all or at least the majority of the general classes of surveillance sensors. This embodiment is likewise based on the idea of initially providing all signature sensors for a complete object signature for all types or general classes of surveillance sensors so that the surveillance sensors that deliver the best detection rate for the particular circumstance can be installed at other locations in the surveillance region.

In terms of signalling, the surveillance sensors and/or the signature sensors are preferably disposed and/or connected in a sensor network e.g. in the form of an LSN bus (LSN: local security network). The sensor network extends within the surveillance region which is designed e.g. in the form of buildings and/or as open space.

A further subject of the invention relates to a method for detecting and/or tracking a surveillance object in a surveillance region, having the features of claim 11. The method is preferably implemented in the surveillance system according to one of the preceding claims, or in the manner described above. In the method, an object signature of the surveillance object is first depicted, preferably in an automated manner, on the basis of object signature information from a plurality of signature sensors, means being provided to enable the object signature information to be assigned distinctly and/or unmistakably to the surveillance object.

A further subject matter relates to a computer program having the features of claim 12.

BRIEF DESCRIPTION OF THE DRAWINGS

Further features, advantages, and effects of the invention result from the following description of a preferred embodiment of the invention. In the drawings:

FIG. 1 shows a schematic block diagram of a surveillance system as a first embodiment of the invention.

EMBODIMENT(S) OF THE INVENTION

FIG. 1 shows a schematic block diagram of a surveillance system 1, as an embodiment of the invention. Surveillance system 1 is designed to detect and/or track surveillance objects 4 in the form of pedestrians in a surveillance region 2 which is limited schematically by lines 3.

In surveillance region 2, a plurality of surveillance sensors 6 is disposed in a building 5; surveillance sensors 6 monitor various subregions 7 in surveillance region 2 and in building 5.

In FIG. 1, subregions 7 are distributed such that they are disposed next to each other at least often without overlap. As such, when surveillance objects 4 are detected or tracked, it is difficult to recognize surveillance object 4 when it transitions from one subregion 7 to the next subregion 7, although this is necessary in order to track surveillance object 4 throughout entire surveillance region 2. One possible source of error is that surveillance object 4 leaves a subregion 7 and is tracked in a subsequent subregion 7 as a new surveillance object 4. This source of error makes it difficult to robustly track surveillance object 4 in surveillance region 2.

To simplify the detection, identification, and tracking of surveillance object 4, surveillance region 2 includes four signature locks 8*a, b, c* and *d* in this example, signature locks 8*a, b, c* and *d* being disposed at the entrances to surveillance region 2. A surveillance object 4 must pass through one of the signature locks 8*a, b, c* or *d* to enter surveillance region 2. It is possible, of course, for surveillance region 2 to include more or fewer signature locks 8*a, b, c, d*.

In this example, each of the signature locks 8*a, b, c, d* includes four signature sensors 9 which are disposed and/or designed such that sensor-specific measurement signals are recorded, as the basis for object signature information, from surveillance object 4 when it passes through signature locks 8*a, b, c*, or *d*; the object signature information is subsequently combined in an evaluation device 10 to form an object signature. Signature sensors 9 are disposed in signature locks 8*a, b, c, d* in a manner such that surveillance object 4 is detected in a spacially and/or temporally correlated manner in particular. Via this correlation it is ensured that the sensor-specific measurement signals that are recorded are definitely from the same surveillance object 4. The object signature resulting from the sensor-specific measurement signals from signature sensors 9 is therefore characterized in that it is definitely formed on the basis of only one surveillance object 4.

Signature sensors 9 are selected such that, for each general class of surveillance sensor 6 or at least for the majority of all general classes of surveillance sensors 6, one signature sensor 9 is provided in the same general class or with a sensor-specific measurement signal compatible therewith. In FIG. 1, the different sensor classes are indicated as triangles, squares, pentagons, and hexagons.

One idea behind surveillance system 1 is that, for each surveillance sensor 6 in signature lock 8*a, b, c, d*, sensor-specific measurement signals are recorded, as the basis for object signature information, and are stored as the object signature. This procedure has the advantage that only individual surveillance sensors 6 that have the best detection performance and/or environmental compatibility, e.g. relative to the actual surroundings, need be disposed in surveillance region 2. The selection of surveillance sensors 6 can also be based on business considerations. Due to the completeness of the object signature, it is sufficient to install one surveillance sensor 6 in each subregion 7, so that the sensor-specific measurement signals obtained therewith can be used, on the basis of the stored object signature, to reliably identify or recognize related surveillance object 4, thereby making it possible to perform detection and tracking. Robust recognition of surveillance objects 4 within surveillance region 2 is achieved, and the most complete and comprehensive collection of information possible about surveillance object 4 to be tracked is obtained one time, in the entrance region to surveillance region 2. Highly diverse and highly different sensors can be used as surveillance sensors 6 or signature sensors 9, such as surveillance cameras for detecting all sides of the view of surveillance object 4 and measuring the actual size and dimensions or volume of surveillance object 4. As a special embodiment of the surveillance cameras, it is also possible to use infrared cameras having a wavelength above 1.000 nm, which can register e.g. the temperature and/or temperature distribution of surveillance object 4. Odor sensors, which can record a specific odor of surveillance object 4, are also possible. A scale for recording the weight of surveillance object 4 is likewise feasible. A further possibility is to use an acoustic sensor, e.g. a microphone, which registers typical sounds such as respiration, heartbeat, or engine noises or footsteps. Further sensors for recording electromagnetic radiation, such as terahertz radiation, are also possible.

It is also possible to use a radiation measurement to detect e.g. computers, cellular telephones, RFID and the like, in order to create an object signature or recognize surveillance object 4. For example, the information content of the radiation, e.g. a cellular telephone identification or an RFID identification information, can be used as the object signature information. This all-around detection of temporally and spacially correlated information on surveillance object 4 offers widely distributed surveillance sensors 6 the data they require to robustly recognize surveillance object 4.

Signature sensors 9 for recording sensor-specific measurement signals to form the object signature are disposed in signature locks 8*a, b, c, d* such that they do not interfere with each other. In the case of signature locks 8*a* and *b*, signature sensors 9 are disposed such that surveillance object 4 can be detected from all sides simultaneously. A plurality of identical signature sensors 9 can also be used simultaneously, e.g. surveillance cameras for the simultaneous detection of a plurality of or all views of surveillance object 4.

In the case of signature lock 8*c*, signature sensors 9 are disposed adjacently in a row; the detection ranges of the signature sensors can be arranged such that they overlap or not. To ensure the spacial and temporal correlation of the sensor signals of signature sensors 9, signature lock 8*b* includes an isolation device 11 that makes it possible for only one single surveillance object 4 to enter signature lock 8*b*.

Signature lock 8*d* is designed analogously to signature lock 8*a* or *b*, although, in contrast thereto, surveillance object 4 is not detected automatically, and instead, detection is activated by the surveillance object actuating a device 12. Device 12 can be designed e.g. as a computer terminal, and can optionally be connected to a closing device 13 which does not allow access to building 5 until the object signature is formed.

Surveillance sensors 6 in surveillance region 2 can be interconnected e.g. via a safety network LSN 14, and to evaluation device 10.

The method for performing the detection, recognition, and tracking of the surveillance object is described below: In a first step, sensor-specific measurement signals for registering object properties of surveillance object 4 are recorded in one of the signature locks 8*a, b, c, d* by signature sensors 9, and are forwarded as object signature information via a network 15, which can likewise form a part of safety network 14, to evaluation device 10. In evaluation device 10, the object signature information is combined to form object signatures 16, e.g. in the form of data records, each data record being assigned in an individualized manner to a surveillance object 4. As an option, the data records are supplemented with additional information from another data base. In alternative embodiments, the measurement signals from signature sensors 9 are transmitted to evaluation device 10, where they are converted into object signature information.

If surveillance object 4 enters surveillance region 2, it is registered, in a further step, by any of the surveillance sensors 6. The sensor-specific measurement signals from surveillance sensor 6 are forwarded via safety network 14 to evaluation device 10, and are compared, in the original form or a processed form, as object information in a comparison module 17 with the object signature 16, which was formed on the basis of the sensor-specific measurement signals from signature sensors 9. If there is a match or sufficient similarity, the identity of surveillance object 4 belonging to data record 16 is assigned to surveillance object 4.

If surveillance object 4 passes from one of the first subregions 7 into a second subregion 7, the procedure is repeated using surveillance sensor 6 disposed in subsequent subregion 7. The totality of positions or further sensor data on a surveillance object 4 assigned via object signature 16 is collected, and can then be evaluated to detect, identify, and track surveillance object 4 in surveillance region 2.

What is claimed is:

1. A surveillance system (1) for detecting and/or tracking at least one moving surveillance object (4) in a surveillance region (2) having a plurality of subregions (7), which subregions (7) are disposed at least partially without overlap, comprising a plurality of surveillance sensors (6) which are and/or can be spatially distributed in surveillance region (2), wherein the surveillance sensors (6) include several general classes of sensors and are designed to detect the surveillance object (4) and output detected object information, a signature lock (8*a*, 8*b*, 8*c*, 8*d*) having at least one signature sensor (9) which is designed and/or disposed to detect the surveillance object (4) and output object signature information, and an evaluation device (10) designed to form and/or supplement an object signature (16) of the surveillance object (4) on the basis of the object signature information and to detect and/or track the surveillance object (4) by comparing detected object information with the object signature (16) of the surveillance object (4), wherein the signature lock (8*a, b, c, d*) includes at least two signature sensors (9) and is designed such that the object signal information of the at least two signature sensors (9) can be assigned or are assignable distinctly and/or unmistakably to the surveillance object (4);

wherein a totality of the signature sensors (9) covers all the several general classes of the sensors, wherein only one surveillance sensor (6) is installed in each subregion (7), and wherein sensor-specific measurement signals obtained from the one surveillance sensor (6) in each subregion (7) is used, according to the stored object signature (16), to reliably identify or recognize the related surveillance object (4).

2. The surveillance system (1) according to claim 1, characterized in that the evaluation device (10) is designed to form the object signature (16) exclusively on the basis of object information detected using the signature sensors (9).

3. The surveillance system (1) according to claim 1, characterized in that the at least two signature sensors (9) are disposed and/or designed to detect the surveillance object (4) in a spatially and/or temporally overlapping manner.

4. The surveillance system (1) according to claim 1, characterized in that the signature locks (8*a*, 8*b*, 8*c*, 8*d*) are designed to isolate the surveillance object (4), wherein the at least two signature sensors (9) are disposed in one isolating region to detect the isolated surveillance object (4).

5. The surveillance system (1) according to claim 1, characterized in that the signature lock (8*a*, 8*b*, 8*c*, 8*d*) is located at an entrance to the surveillance region (2).

6. The surveillance system (1) according to claim 1, characterized in that the signature lock (8*a*, 8*b*, 8*c*, 8*d*) is designed for automated activation of the detection of the surveillance object (4).

7. The surveillance system (1) according to claim 1, characterized in that the signature lock (8*a*, 8*b*, 8*c*, 8*d*) is designed for manual activation of the detection of the surveillance object (4).

8. The surveillance system (1) according to claim 1, characterized in that the signature sensors (9) and/or the surveillance sensors (6) comprise one or more of the following general classes of sensors:

Surveillance cameras;
Odor sensors;
Temperature sensors;
Scale'
Acoustic sensors;
Sensors for detecting electromagnetic radiation;
Sensors for detecting biometric data.

9. The surveillance system (1) according to claim 1, characterized in that the surveillance sensors (6) and/or the signature sensors (9) are located in one sensor network (14, 15).

10. A method for detecting and/or tracking a moving surveillance object (4) in a surveillance region (2), the surveillance region (2) comprising a plurality of spatially distributed surveillance sensors (6) that include several general classes of sensors, a plurality of subregions (7) positioned at least partially without overlap in the surveillance region (2), wherein only one surveillance sensor (6) is installed in each subregion (7) and a plurality of signature locks (8*a*, 8*b*, 8*c*, 8*d*) formed with at least two signature sensors (9) that cover all the several general classes of sensors, wherein the signature locks (8*a*, 8*b*, 8*c*, 8*d*) are disposed in entrances to the surveillance region (2), and wherein the method is implemented in an evaluation device (10) that is in electrical communication with the surveillance sensors (6) and the signature sensors (9) and comprises steps of:

recording, in one of the at least two signature sensors (9) in one of the signature locks (8*a*, 8*b*, 8*c*, 8*d*), sensor-specific measurement signals for registering object properties of the surveillance object (4);

forwarding the sensor-specific measurement signals as object signature information to the evaluation device (10);

combining, in the evaluation device (10), the object signature information from the one signature sensor (9) to form object signatures (16) in the form of data records;

distinctly and/or unmistakably assigning each data record in an individualized manner to each surveillance object (4); and detecting and/or tracking the surveillance object (4) by comparing detected object information with the object signature (16) of the surveillance object (4);

wherein sensor-specific measurement signals obtained from the one surveillance sensor (6) in each subregion (7) are used, according to the stored object signature (16), to reliably identify or recognize the related surveillance object (4).

11. A computer program product comprising program code means embodied in a non-transitory computer readable medium for carrying out all steps of the method as recited in claim 10 when the program code means is run on a computer and/or the evaluation a device (10).

* * * * *